United States Patent [19]

Kakehi et al.

[11] 4,449,019

[45] May 15, 1984

[54] PIEZOELECTRIC LOUDSPEAKER

[75] Inventors: Sasuga Kakehi, Kanazawa; Nobuhiko Nakagawa, Ishikawa; Hideo Adachi, Kanazawa; Tadashi Takaya, Kanazawa, all of Japan

[73] Assignee: Murata Manufacturing Co., Ltd., Japan

[21] Appl. No.: 319,362

[22] Filed: Nov. 9, 1981

[30] Foreign Application Priority Data

Nov. 11, 1980 [JP] Japan ..... 55-158559

[51] Int. Cl.[3] ..... H04R 17/10

[52] U.S. Cl. ..... 179/110 A

[58] Field of Search ..... 179/110 A; 181/167, 181/170, 160, 182

[56] References Cited

U.S. PATENT DOCUMENTS 2,718,272 9/1955 Olson ..... 181/160
3,708,702 1/1973 Brunnert et al. ..... 179/110 A
4,240,002 12/1980 Tosi et al. ..... 179/110 A

FOREIGN PATENT DOCUMENTS 18614 12/1980 European Pat. Off. ..... 181/167
55-35558 12/1980 Japan ..... 179/110 A

*Primary Examiner*—Harold I. Pitts
*Assistant Examiner*—L. C. Schroeder
*Attorney, Agent, or Firm*—Ostrolenk, Faber, Gerb & Soffen

[57] ABSTRACT

A piezoelectric loudspeaker using a thin plate of piezoelectric ceramics of a high dielectric constant, and fixing a piezoelectric transducer including a thin plate of piezoelectric ceramic of a high dielectric constant onto a diaphragm stretched on a frame, thereby forming a sound generator.

The piezoelectric loudspeaker is so constructed that the resonance frequency of the sound generator is set at the low frequency band side of an audio frequency region and that of a cavity by the frame is set at the high frequency band side, the thin plate piezoelectric ceramic of high dielectric constant being used, so that the piezoelectric loudspeaker is of an ultrathin type and can cover the whole audio frequency region.

5 Claims, 2 Drawing Figures

PIEZOELECTRIC LOUDSPEAKER

This invention relates to a piezoelectric loudspeaker which is of an ultrathin shape and can cover the whole audio frequency region.

A speaker used in electronic apparatus, such as a radio receiver or voice syntheze apparatus is an electrokinetic loudspeaker, especially the electrokinetic lousspeaker being superior in performance due to covering the audio frequency region overall.

Recently, it has been highly promoted that the electronic apparatus provided with the loudspeaker is made smaller in thickness, but the electrokinetic louspeaker to be housed in the apparatus is structurally difficult to make smaller in thickness, which is a great hindrance to production of such electronic apparatus smaller in thickness.

Therefore, attention has been paid to the use of piezoelectric loudspeaker for manufacturing the electronic apparatus smaller in thickness.

Figure 1:
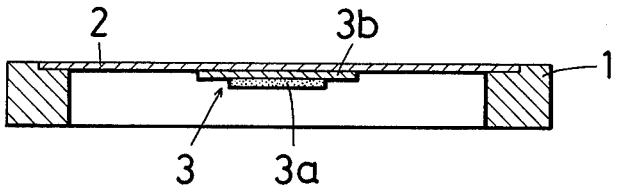

The conventional piezoelectric loudspeaker, as shown in FIG. 1, is so constructed that a diaphragm 2 is fixed to a frame 1 and a piezoelectric transducer 3 is stuck by an adhesive to the center of diaphragm 2, the transducer 3 being formed of a piezoelectric ceramic plate 3*a* provided at both sides or one side thereof with electrodes and fixed to a metallic plate 3*b*.

At present, such piezoelectric loudspeaker is put to practical use only as a speaker for the high frequency band, i.e., a tweeter, because, even in consideration of various conditions as to the piezoelectric transducer and cavity, it is extremely difficult to obtain a sufficient sound-pressure level throughout the audio frequency region including a low frequency band.

For example, in order to expand the low frequency band, the method such that a cavity is provided at the output side of speaker to lower the resonance frequency, is usually adopted.

When the cavity lowers resonance frequency, enough sound-pressure needed for the speaker cannot be gained.

Such conventional piezoelectric speaker is not effective in practical use in comparison with the electrokinetic speaker, resulting in that the piezoelectric loudspeaker now is not put to practical use as the tweeter. Accordingly, electrokinetic speaker must be used in electronic apparatus, resulting in the electronic apparatus having been restricted by the speaker from being made smaller in thickness.

A piezoelectric loudspeaker of this invention is so constructed that a piezoelectric transducer employing a thin plate piezoelectric ceramic of high dielectric constant is fixed to a diaphragm stretched onto a film to thereby form a sound generator, whereby the resonance frequency thereof is set at the low frequency band side of audio frequency region and that of the cavity formed by frame at the high frequency band side.

An object of the invention is to provide a piezoelectric loudspeaker which can solely obain a sufficient sound-pressure level even with an ultrathin type so that the electronic apparatus using the loudspeaker can be reduced in thickness.

Another object of this invention is to provide piezoelectric loudspeaker by which enough sound-pressure level covering audio frequency region overall can be obtained.

The above and other objects and features of the invention will appear more fully hereinafter from a consideration of the following description taken in connection with the accompanying drawing wherein one example is illustrated by way of example.

Figure 2:
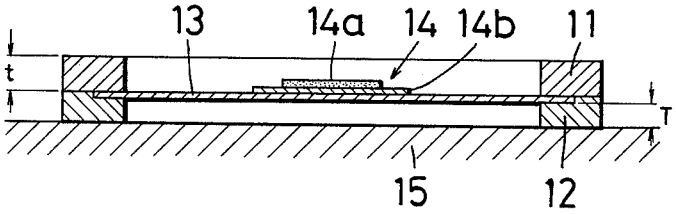

FIG. 1 is a longitudinally sectional view of a conventional piezoelectric loudspeaker, and FIG. 2 is a longitudinally sectional view of an embodiment of a piezoelectric loudspeaker of the invention.

Referring to FIG. 2 a piezoelectric loudspeaker of the invention comprises a pair of ring frames 11 and 12, an extremely disk-type thin diaphragm 13 sandwiched between both the ring frames 11 and 12, and a disk-type piezoelectric transducer 14 stuck onto the diaphragm 13.

The diaphragm 13 is composed of a plastic film, cone paper, or metal foil or the like and sandwiched between first and second overlapped ring frames 11 and 12 in condition of being subjected to tension.

The piezoelectric transducer 14 is formed of an ultrathin disk-type piezoelectric ceramic plate 14*a* of a high dielectric constant stuck by adhesive onto an extremely thin disk-type metal sheet 14*b*, the piezoelectric ceramic 14*a* being provided at both surfaces or one surface opposite side of metal sheet thereof with electrodes (not shown).

In addition, the piezoelectric transducer 14 is stuck to diaphragm 13 by, for example, an adhesive.

Next, a preferred embodiment of the loudspeaker of the invention will be detialed according to values of components.

The diaphragm 13 is formed of an epoxy resin film of 0.07 mm in thickness, the piezoelectric ceramic plate 14*a* 25 mm in diameter and 0.1 mm in thickness being made of piezoelectric ceramics such as PZT. In addition, the dielectric constant of piezoelectric ceramic usually used is about 300 to 1000.

The metal sheet 14*a* is formed of a brass sheet of 27 mm in diameter and 0.1 mm in thickness.

Resonance frequency $fo$ of sound generator comprising diaphragm 13 and piezoelectric transducer 14 in the above condition, depends upon the diameter and thickness of the sound generator so as to be set at the low frequency band side of about 1 kHz at the audio frequency region in the case of the above embodiment. In addition, the frequency of piezoelectric transducer 14 is about 2.5 kHz.

The sound pressure of sound generator is represented by the following equation:

$$\begin{aligned}\text{Sound Pressure} &= \text{Pin} \times \zeta \\ &= \frac{V^2}{Z} \times \zeta \\ &= 2\pi f C V^2 \times \zeta,\end{aligned}$$

where Pin: input power, $\zeta$: transformation efficiency, V: input voltage, Z: impedance of sound generator, $f$: frequency, and C: capacity of piezoelectric ceramic plate.

In the above embodiment, piezoelectric ceramic plate of a considerably high dielectric constant of about 3500 and of a small thickness of 0.1 mm, increases in capacity C.

Therefore, the sound pressure will increase, and especially even in the low frequency band, can be maintained at a high level. The resonance frequency of sound generator is lower and capacity becomes larger as such, thereby raising the sound-pressure level at the low frequency band.

Now, in a case that the 1st ring frame 11 constituting the cavity of loudspeaker is changed in thickness t to 1.6, 3.2, 4.8 and 6.4 mm, resonance frequency *fc* caused by the cavity resonance changes resulting in rise in sound-pressure level at the high frequency band side. Data of the table shows the results from measurement by using the speaker consisting of the above sound generator, the first ring frame 11 of 40 mm in an inner diameter and the second ring frame 12 of 1.6 mm in thickness T, the said speaker in condition of being placed on a base 15.

| Thickness t (mm) | Change Point (Frequency kHz) |
|---|---|
| 1.6 | 12.0 |
| 3.2 | 10.0 |
| 4.8 | 7.0 |
| 6.4 | 4.0 |

The first ring frame 11 is reduced in thickness t as foregoing, the resonance frequency *fc* caused by the cavity is set at the high frequency band side, the resonance frequency *fo* of sound generator is set at the low frequency band side, and its capacity C is increased, whereby the frequency characteristic of loudspeaker becomes flat throughout the audio frequency region and a sufficient sound-pressure is gained. Hence, by use of the sole piezoelectric loudspeaker of an ultrathin type, the loudspeaker covering the audio frequency region overall can be put to practical use, thereby considerably promoting electronic apparatus to be reduced in thickness.

In addition, in the above embodiment, the piezoelectric transducer 14 of unimorph may alternatively be of bimorph of two piezoelectric ceramic plate stuck to each other, or be formed of a single piezoelectric ceramic.

What is claimed is:

1. A piezoelectric loudspeaker having a piezoelectric transducer including a thin plate of piezoelectric ceramic of a high dielectric constant, said transducer being fixed to a diaphragm streteched onto frame, so that the resonance frequency of a sound generator comprising said piezoelectric transducer and diaphragm is set at a low frequency band side of an audio frequency region and the resonance frequency of a cavity formed by said frames is set at a high frequency band side.

2. A piezoelectric loudspeaker according to claim 1, wherein said piezoelectric transducer is formed of a laminated member comprising said thin film piezoelectric ceramic of a high dielectric constant and an extremely thin metallic sheet, said laminated member being stuck onto said diaphragm.

3. A piezoelectric loudspeaker according to claim 1, wherein said frames comprises a first frame and a second frame, said diaphragm being sandwiched fixedly between said first and second frames.

4. A piezoelectric loudspeaker according to claim 1, wherein said diaphragm is formed of an epoxy resin film.

5. A piezoelectric loudspeaker according to claim 1, wherein said piezoelectric ceramic has a dielectric constant of about 3,500.

* * * * *